US007784919B2

(12) United States Patent
Weaver

(10) Patent No.: US 7,784,919 B2
(45) Date of Patent: Aug. 31, 2010

(54) METHODS FOR IMPROVING FLOW THROUGH FLUIDIC CHANNELS

(75) Inventor: Sean T. Weaver, Union, KY (US)

(73) Assignee: Lexmark International, Inc., Lexington, KY (US)

( * ) Notice: Subject to any disclaimer, the term of this patent is extended or adjusted under 35 U.S.C. 154(b) by 903 days.

(21) Appl. No.: 11/241,220

(22) Filed: Sep. 30, 2005

(65) Prior Publication Data

US 2007/0076058 A1 Apr. 5, 2007

(51) Int. Cl.
*B41J 2/05* (2006.01)
*B41J 2/135* (2006.01)

(52) U.S. Cl. ..... 347/65; 347/45

(58) Field of Classification Search ..... 347/20, 347/45, 65

See application file for complete search history.

(56) References Cited

U.S. PATENT DOCUMENTS

| | | | | |
|---|---|---|---|---|
| 4,243,718 | A * | 1/1981 | Murai et al. | 428/447 |
| 5,700,581 | A | 12/1997 | Sachdev et al. | |
| 5,847,730 | A | 12/1998 | Miyashita et al. | |
| 6,123,994 | A | 9/2000 | Ito et al. | |
| 6,286,941 | B1 * | 9/2001 | Courian et al. | 347/65 |
| 2002/0036673 | A1 | 3/2002 | Miyoshi et al. | |

* cited by examiner

*Primary Examiner*—An H Do

(57) ABSTRACT

Methods for improving fluid flow in one or more flow features of a micro-fluid ejection head and micro-fluid ejection heads having improved fluid flow. One method includes bonding a substrate having a flow feature layer to an ejection head body using a relatively low stress, substantially flexible adhesive containing a relatively volatile polar organic compound. The adhesive is cured under conditions sufficient to induce out-gassing of at least a portion of the relatively volatile polar organic compound on at least a portion of a flow feature surface sufficient to increase fluid wetting of the flow feature surface.

10 Claims, 5 Drawing Sheets

METHODS FOR IMPROVING FLOW THROUGH FLUIDIC CHANNELS

FIELD OF THE DISCLOSURE

The disclosure is directed to micro-fluid ejecting devices and more specifically to structures and methods for improving fluid flow in a micro-fluid ejection head.

BACKGROUND AND SUMMARY

Micro-fluid ejecting devices such as ink jet printers continue to be improved as the technology for making the printheads continues to advance. New techniques are constantly being developed to provide low cost, highly reliable printers which approach the speed and quality of laser printers.

One area of improvement in the micro-fluid ejecting devices is in the ejection head itself. This seemingly simple device is a microscopic marvel containing electrical circuits, fluid passageways and a variety of tiny parts assembled with precision to provide a powerful, yet versatile component of the printer. The components of the ejection head must also cooperate with an endless variety of fluids to provide the desired ejection functions. Accordingly, it is important to match the ejection head components to the fluid and the duty cycle demanded by the ejection application. Slight variations in production quality can have a tremendous influence on the product yield and resulting ejection head performance.

A micro-fluid ejection head typically includes a semiconductor chip and a nozzle plate attached to the chip. Flow features, including fluid flow channels and fluid ejection chambers are included in the nozzle plate or in a separate thick film layer attached to the semiconductor chip between the nozzle plate and the chip. The semiconductor chip is typically made of silicon and contains various passivation layers, conductive metal layers, resistive layers, insulative layers and protective layers deposited on a device surface thereof. Individual fluid ejection actuators such as heater resistors are defined in the resistive layers and each fluid ejection actuator corresponds to a nozzle hole in the nozzle plate for ejecting fluid from the micro-fluid ejection head. Fluid is supplied to the fluid flow channels and fluid ejection chambers from a slot which is formed as by chemically etching, grit blasting, or a deep reactive ion etching (DRIE) technique such as is described in U.S. Pat. No. 6,402,301 to Powers et al. through the thickness of the semiconductor chip.

As advances are made in fluid ejection speed and accuracy, a need arises for an increased number of ink ejection actuators which are more closely spaced on the silicon chips. Decreased spacing between the ink ejection actuators requires more reliable fluid feed techniques for supply fluid to the individual fluid ejection actuators. As the complexity of the micro-fluid ejection head continues to increase, there is also a need for long-life ejection heads that can be produced in high yield while meeting more demanding manufacturing tolerances. Thus, there continues to be a need for improved manufacturing processes and techniques which provide improved ejection heads and ejection head components.

With regard to the above and other objects, the disclosure provides methods for improving fluid flow in one or more flow features of a micro-fluid ejection head. One such method involves bonding a substrate having a flow feature layer to an ejection head body using a relatively low stress, substantially flexible adhesive containing a relatively volatile polar organic compound. The adhesive is cured under conditions sufficient to induce outgassing of at least a portion of the relatively volatile polar organic compound on at least a portion of a flow feature surface sufficient to increase fluid wetting of the flow feature surface.

In another exemplary embodiment, the disclosure provides a micro-fluid ejection head having a substrate holder, a substrate, a relatively low stress, substantially flexible adhesive adhesively attaching the substrate to the substrate holder on a first surface of the substrate, and a flow feature containing material adjacent a second surface of the substrate. The adhesive is effective to increase the surface energy of one or more of flow features in the flow feature containing material.

Yet another embodiment of the disclosure provides a method for increasing the surface energy of one or more flow features of a micro-fluid ejection head. A substrate is adhesively bonded to a substrate holder using a relatively low stress, substantially flexible adhesive containing from about 1 to about 50 percent by weight of a relatively volatile polar organic compound. The adhesive is cured under conditions sufficient to promote deposits of the polar organic compound on one or more surfaces of the one or more flow features thereby increasing the surface energy of the one or more flow features.

An advantage of at least some of the exemplary embodiments described herein is that fluid flow through narrow channels or passages in a micro-fluid ejecting head can be significantly improved. Without desiring to be bound by theory, it is believed that the relatively volatile polar organic compound may mask hydrophobic compounds and monomers that also deposit on the flow feature surfaces during the curing process. The hydrophobic compounds and monomers lower the surface energy of the flow feature surfaces while the relatively volatile polar organic compounds increase the surface energy of the flow feature surfaces.

Surfaces with relatively low surface energy have decreased wettability as compared to surfaces having relatively higher surface energy. As the wettability of the flow feature surfaces decreases, the resistance to fluid flow through the flow features is increased. Increased fluid flow resistance may contribute to reduced fluid flow or fluid starvation to ejection chambers of the micro-fluid ejecting head. Under high frequency operation, misfiring of the ejection actuators may result if the ejection chambers are not adequately refilled between fluid ejection actuation cycles. By increasing the surface energy of the flow features, the disclosed embodiments may significantly improve fluid flow to the ejection chambers.

Additionally, flow features having relatively low surface energy are more likely to attract and hold air bubbles which can impede fluid flow. While not desiring to be bound by theory, it is believed that increasing the surface energy of the flow features reduces the accumulation of air bubbles in the flow features of the micro-fluid ejection head.

BRIEF DESCRIPTION OF THE DRAWINGS

Further advantages of the exemplary embodiments may become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
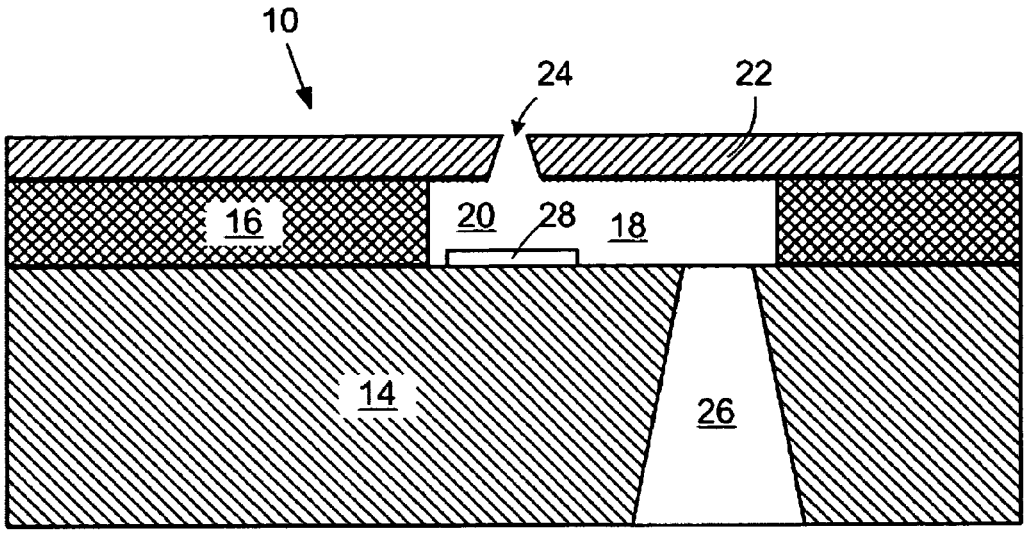
FIGS. 1 and 2 are a cross-sectional view, not to scale, of portions of micro-fluid ejection heads.
Figure 2:
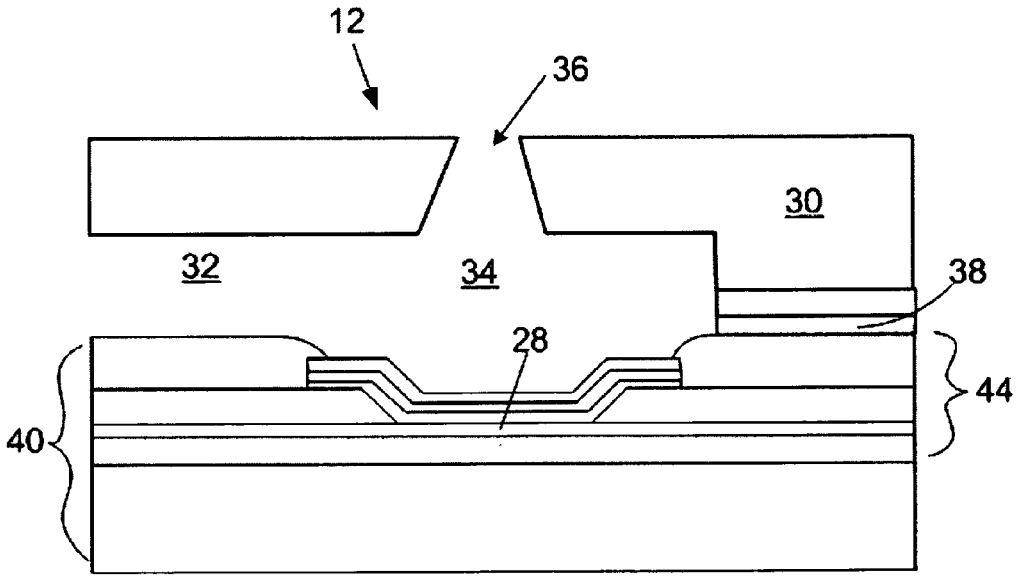

With reference to FIGS. 1 and 2, cross sectional views, not to scale, of portions of micro-fluid ejection heads 10 and 12 are illustrated. The micro-fluid ejection head 10 includes a substrate, such as semiconductor substrate 14, to which a thick film layer 16 is attached. In the micro-fluid ejection head illustrated in FIG. 1, the thick film layer 16 is made of a photoimageable material that is applied to the substrate 14, that is imaged and developed to provide fluid flow channels 18 and fluid ejection chambers 20. A separate nozzle plate 22 containing nozzle holes 24 is attached to the thick film layer 16. For the purposes of this disclosure, the fluid flow channel 18, the fluid ejection chamber 20, and the nozzle hole 24 are collectively referred to as "flow features." A fluid supply slot 26 is etched or grit blasted through the substrate 14 to provide fluid flow communication between the flow features and a fluid supply source. A fluid ejection actuator 28 is provided on the substrate 14 in the fluid ejection chamber 20 for causing fluid to be ejected through the nozzle hole 24 upon activation of the actuator 28.

The micro-fluid ejection head 12 illustrated in FIG. 2 is an alternate design wherein flow features are provided in a single nozzle plate layer 30. In this case, the nozzle plate layer 30 may be a polyimide material that is laser ablated to provide a fluid flow channel 32, a fluid ejection chamber 34, and a nozzle hole 36 therein. The nozzle plate layer 30 is attached, as by an adhesive 38, to a semiconductor substrate 40.

As shown in more detail in FIG. 2, the substrates used for ejection heads 10 and 12 can include a silicon substrate 42 and a plurality of insulative, conductive, and resistive layers 44 deposited on the silicon substrate 42. The layers 44 include the ejection actuator 28 and conductive tracing for actuation of the actuator 28. The semiconductor substrate 40 is relatively small in size and typically has overall dimensions ranging from about 2 to about 10 millimeters wide by about 10 to about 36 millimeters long.

Figure 3:
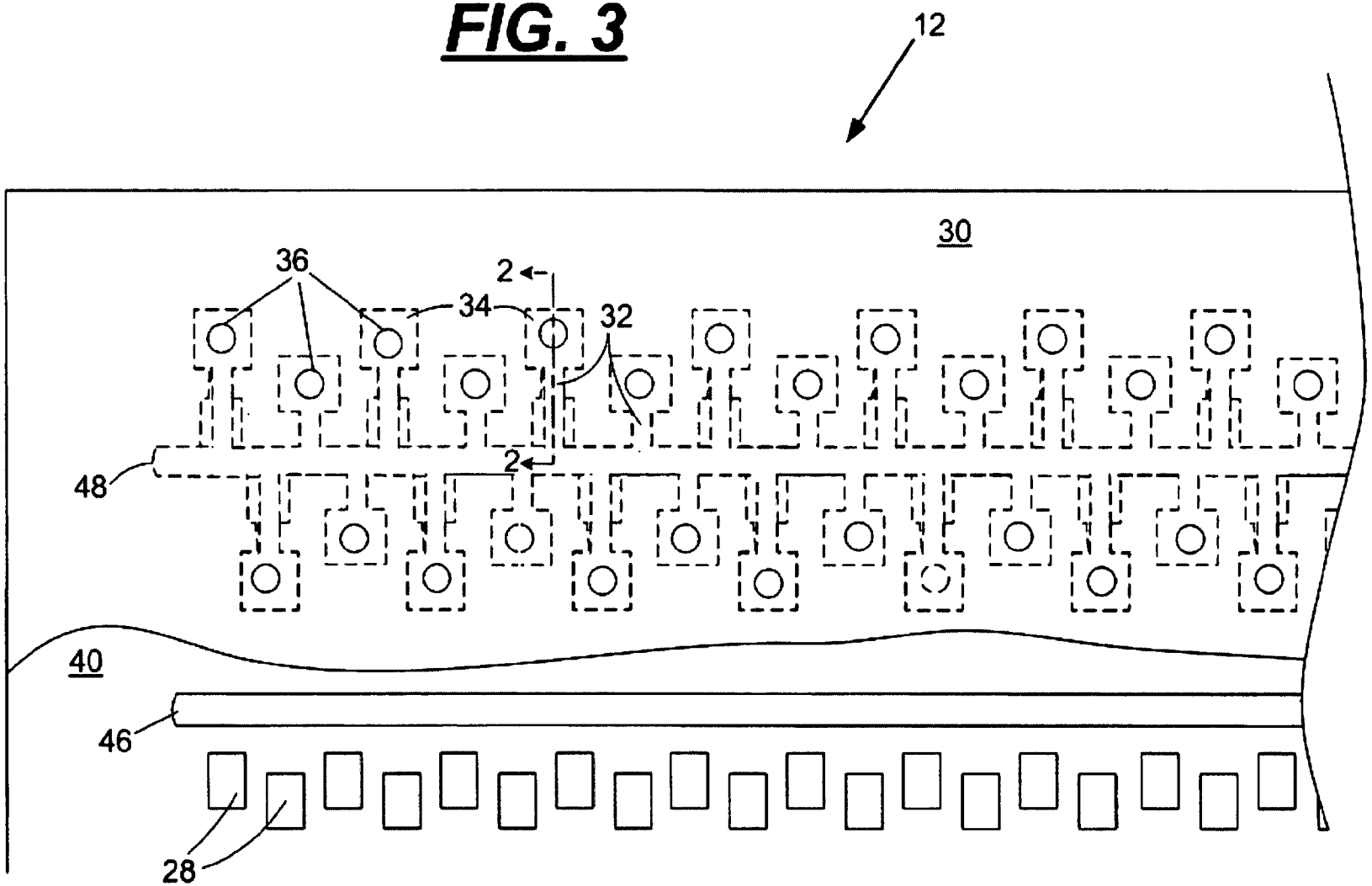
FIG. 3 is a plan view, not to scale, of a portion of a micro-fluid ejection head containing multiple fluid supply slots.

A plan view of a portion of the micro-fluid ejection head 12 is illustrated in FIG. 3. As shown, the substrate 40 includes a plurality of fluid supply slots 46 and 48 with fluid ejection actuators 28 disposed adjacent to the slots 46 and 48. The slots 46 and 48 have dimensions which range from about 5.0 to about 10 millimeters long and from about 0.185 to about 0.39 millimeters wide. The depth of the slots may range from about 400 to about 800 microns. The fluid ejection chambers 34 have dimensions ranging from about 1500 $\mu m^3$ to about 10,000 $\mu m^3$. The fluid supply channels 32 have dimensions ranging from about 10 to about 50 microns high by about 10 to about 50 microns wide and from about 5 to about 80 microns long. The nozzle holes 36 have exit diameters ranging from about 8 to about 30 microns. Accordingly, it will be appreciated that each of the slots 46 and 48 and flow features have dimensions which may impede fluid flow.

During a fluid ejection operation such as printing with an ink, an electrical impulse is provided from a controller to activate one or more of the ejection actuators 28 on the ejection head 12 thereby forcing fluid in the fluid chambers 34 through nozzle holes 36. Fluid is caused to refill the fluid chamber 34 by capillary action and flow through the fluid channel 32. The fluid flows from a fluid supply reservoir 50 (FIG. 4) through the fluid supply slots 46 and 48 and into the fluid channel 32 and the fluid chamber 34.

The fluid reservoir 50 includes a body portion 52 and an ejection head portion 54. The body portion 52 and head portion 54 are typically made of a metal or a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene oxide/high impact polystyrene resin blend available from G.E. Plastics under the trade names NORYL SE1 and polyamide/polyphenylene ether resin available from G.E. Plastics under the trade name NORYL GTX. An exemplary polymeric material for making the fluid reservoir 50 is NORYL SE1 polymer.

Figure 4:
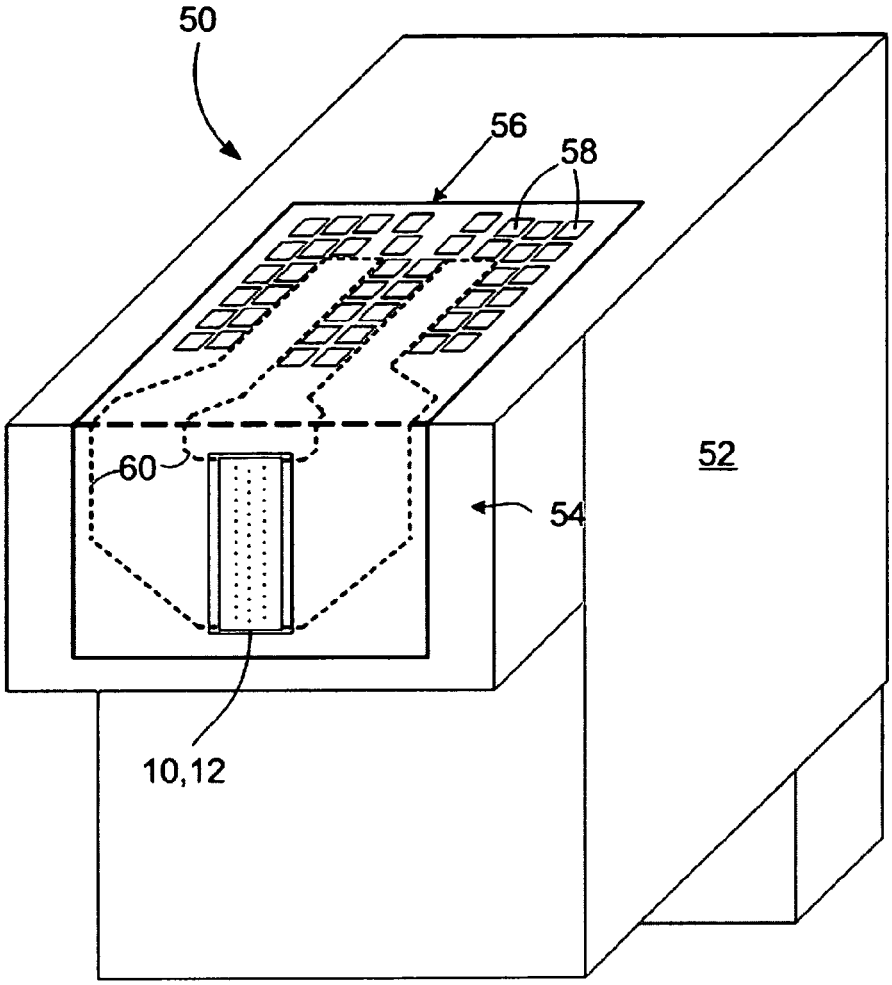
FIG. 4 is a perspective, not to scale, of a fluid reservoir containing a micro-fluid ejection head.
Figure 5:
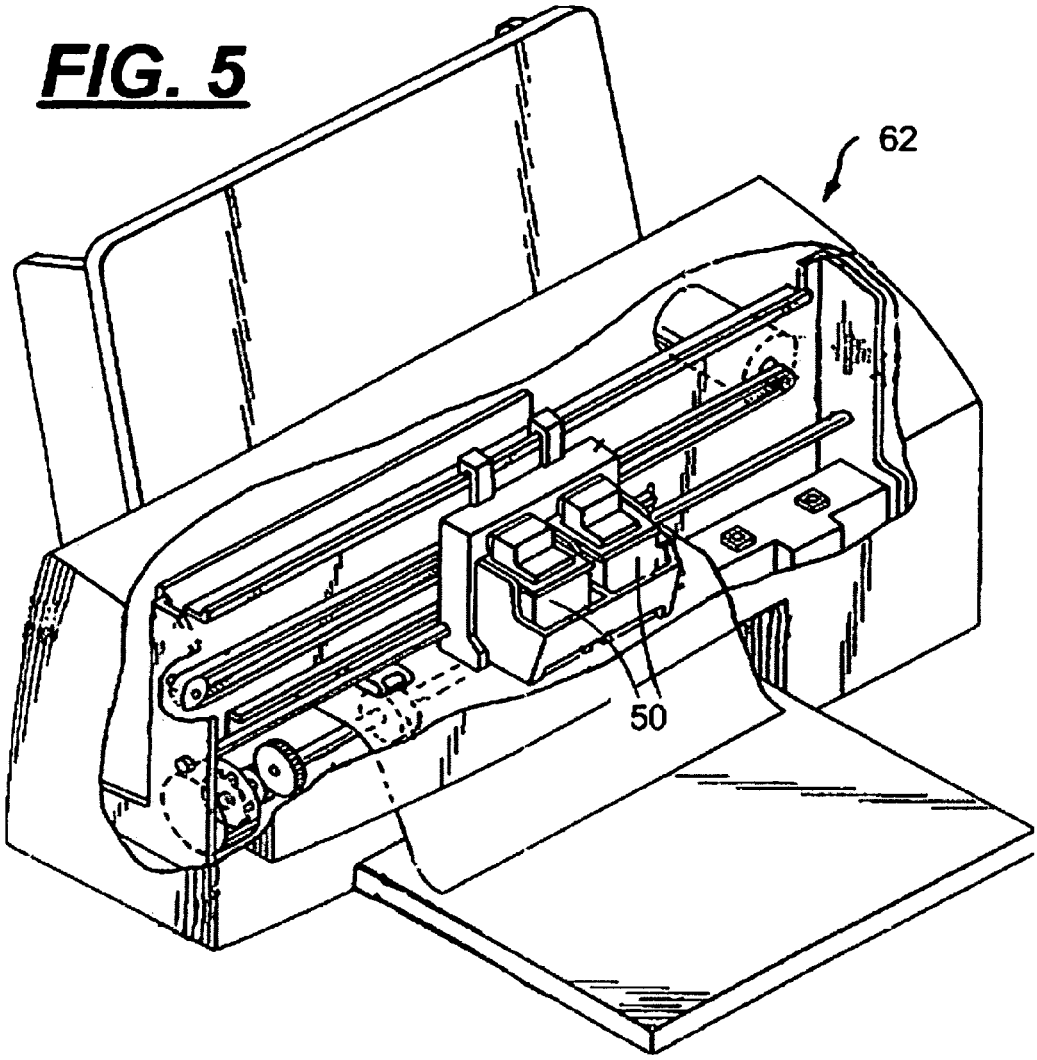
FIG. 5 is a perspective view of an ink jet printer containing fluid reservoirs.

As shown in FIG. 4, the micro-fluid ejection head 10 or 12 can be attached to the ejection head portion 54 of the fluid reservoir 50. Electrical impulses used to activate the ejection actuators 28 are provided to the ejection head 10 or 12 via a flexible circuit 56 that is also attached to the body portion 52 and head portion 54 of the fluid reservoir 50. The flexible circuit 56 contains contact pads 58 thereon which are electrically connected through conductive tracing 60 to the ejection head 10 or 12. Electrical impulses for activation of the ejection actuators 28 are provided by a controller typically situated in a device such as an ink jet printer 62 illustrated in FIG. 5.

Figure 6:
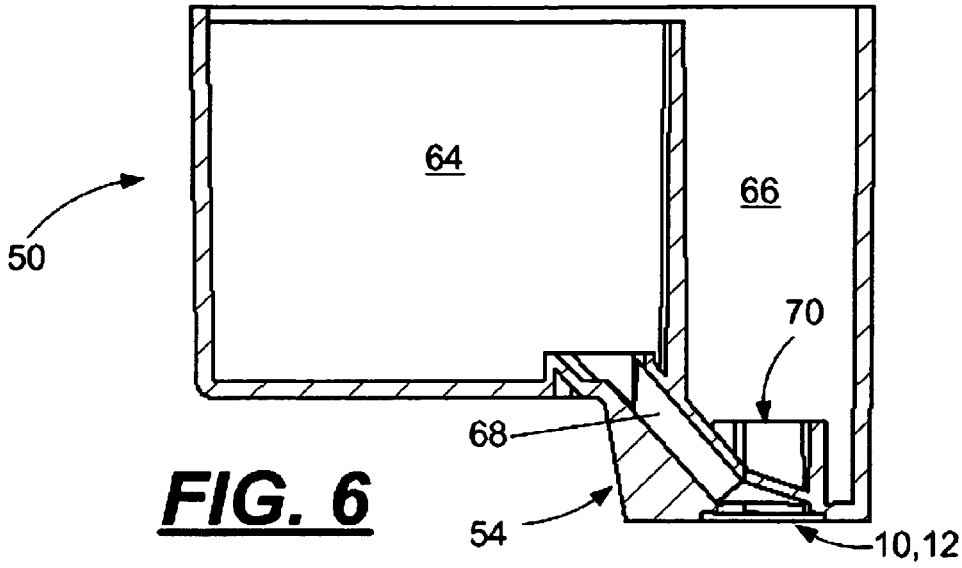
FIG. 6 is a cross-sectional view, not to scale, of a fluid reservoir containing a micro-fluid ejection head.
Figure 7:
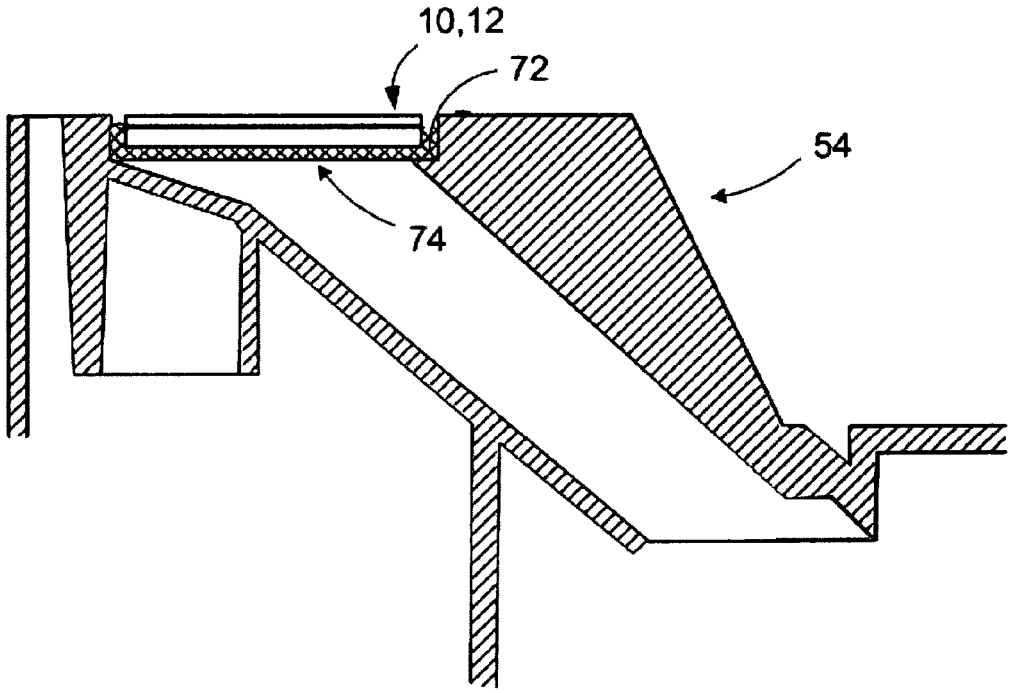
FIG. 7 is an enlarged cross-sectional view, not to scale, of a portion of the fluid reservoir of FIG. 6.

As shown in more detail in FIGS. 6 and 7, the ejection head 10 or 12 can be attached to the head portion 54 of the reservoir 50 so that fluid in one or more chambers, such as chambers 64 and 66 may be provided to the ejection head 10 or 12 through fluid supply paths 68 and 70, respectively. The ejection head 10 or 12 is attached as by a die bond adhesive 72 in a chip pocket 74 of the ejection head portion 54 as shown in FIG. 7. The adhesive 72 can be applied around a perimeter of slots formed in the ejection head portion 54.

A prior art die bond adhesive used to attach the micro-fluid head 10 or 12 to the head portion 54 of the reservoir body 50 is an epoxy adhesive containing about 10 percent by weight of an anhydride and is available from Emerson & Cuming of Monroe Township, N.J. under the trade name ECCOBOND 3193-17. In the case of a thermally conductive head portion 54, the die bond adhesive may be filled with thermal conductivity enhancers such as silver or boron nitride.

The ECCOBOND 3193-17 adhesive described above is a relatively inflexible adhesive that has a glass transition temperature of about 80° C. and is typically cured at a temperature ranging from about 100° to about 120° C. Accordingly, during a curing process for the prior art die bond adhesive, stresses may develop in the adhesive or reservoir body which induce bowing of the ejection head 10 or 12. Such bowing can damage and/or otherwise affect the performance of the ejection head 10 or 12.

In order to reduce stresses in the ejection head 10 or 12 when adhesively attaching the head 10 or 12 to the fluid reservoir 50, a more flexible or stress-absorbing die bond adhesive may be used. Such an adhesive may be selected from silicone adhesives, epoxy modified butadiene adhesives, and siloxane modified epoxy resin adhesives that have a relatively low elastic modulus and a relatively low glass transition temperature compared to the prior art relatively inflexible adhesive described above. For example, silicone adhesives may be cured at temperatures ranging from room temperature to about 110° C.

However, during the curing process for the silicone based adhesives, residual monomers and/or relatively volatile siloxane fragments in the adhesive outgas and deposit on the fluid supply slot 26 surfaces and the flow features surfaces of the ejection head 10 or 12. These residual monomers and/or siloxane fragments decrease the surface energy of the slot 26 and flow feature surfaces thereby reducing the wetting characteristics of such surfaces toward aqueous based fluids. When the wetting characteristics of the surfaces are decreased, fluid flow is affected and may result in starvation or blockage of fluid from the ejection actuators 28 thereby affecting ejection head performance.

In order to counteract the deposition of hydrophobic molecules and fragments on the surfaces of the supply slot 26 and flow features, various types of relatively volatile polar organic compounds can be mixed with a relatively low stress, substantially flexible die bond adhesive. For example, a suitable die bond may comprise one having a Young's moduli in a range of about 0.2 to about 50 mPa, such as one having a Young's moduli in the range of about 0.2 to about 30 mPa. Without desiring to be bound by theory, it is believed that the polar compounds outgas during the curing process for the die bond adhesive and deposit on the surfaces of the slots 26 and flow features thereby masking or counteracting the hydrophobic materials outgassed from the die bond adhesives. Suitable polar compounds that may be mixed with the silicon, epoxy modified butadiene, and siloxane modified epoxy resin adhesive, include, but are not limited to anhydrides, silanes, and carboxylic acid esters. Specific examples include ethanoic anhydride, cyclopropanecarboxylic propanoic anhydride, butanedioic anhydride, succinic anhydride, cyclohexanecarboxylic anhydride, hexanoic anhydride, phthalic anhydride, methyl tetrahydrophthalic anhydride, acetic propionic anhydride, acetic chloroacetic anhydride, γ-glycidoxy-propyltrimethoxysilane, methyl ethanoate, ethyl ethanoate, methyl propanoate, and methyl butyrate. Such compounds typically have a vapor pressure of about one atmosphere at a temperature of about 110° C.

Figure 8:
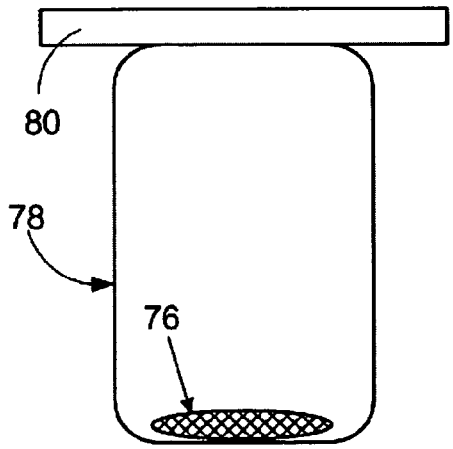
FIG. 8 is a schematic illustration of an apparatus used to measure contact angles of adhesives.

In order to demonstrate the ability of such polar compounds to decrease the hydrophobicity of a surface, a simple experiment was conducted as described below with reference to FIG. 8. A fixed volume of adhesive 76 was dispensed into a 25 ml plastic bottle 78. The plastic bottle 78 was capped with a clean glass microscope slide 80 that was taped to the bottle 78. The bottle 78 containing the adhesive 76 and the microscope slide 80 were placed into a convection oven curing the adhesive 76. Once the adhesive 76 was cured, the glass slide 80 was removed and the resulting contact angle with water was determined. The foregoing procedure was repeated for adhesives containing various amounts of polar compounds. For comparison purposes, the higher the contact angle, the lower the surface energy. The following table contains comparative results of water contact angles on the glass slides 80 provided by outgassed components from the adhesive 76 conducted according to the foregoing procedure.

| Sample No. | Adhesive | Wt. % Polar Compound | Contact Angle (in°) |
|---|---|---|---|
| 1 | Prior Art Epoxy Adhesive | 10 | 24 |
| 2 | Prior Art Epoxy Adhesive | 34.3 | 23 |
| 3 | Silicone Resin Adhesive | 0 | 84 |
| 4 | Silicone Resin Adhesive | 5 | 55 |

-continued

| Sample No. | Adhesive | Wt. % Polar Compound | Contact Angle (in°) |
|---|---|---|---|
| 5 | Siloxane Modified Epoxy Adhesive | 0 | 62 |
| 6 | Siloxane Modified Epoxy Adhesive | 3.9 | 41 |
| 7 | Siloxane Modified Epoxy Adhesive | 7.4 | 35 |
| 8 | Epoxy Modified Butadiene Adhesive | 0 | 51 |
| 9 | Epoxy Modified Butadiene Adhesive | 5.5 | 19 |
| 10 | Epoxy Modified Butadiene Adhesive | 10.3 | 19 |

In the foregoing example, Sample Nos. 1 and 2 were tested to provide a base-line water contact angle. While the water contact angle is acceptable for Sample Nos. 1 and 2, as mentioned above, such prior art adhesive is substantially inflexible and thus does not relieve stresses induced in the ejection head 10 or 12. Sample numbers 3, 5 and 8 illustrate the detrimental effect more flexible adhesives have on the water contact angle when a polar compound is not present in the adhesive. By comparison, the water contact angles for the flexible adhesives 3, 5, and 8 are significantly reduced by adding from about 4 to about 7.5 weight percent of polar compound to the adhesive. The polar compound added to Sample Nos. 2, 4, 6-7 and 9-10 was methyl tetrahydrophthalic anhydride. It is interesting to note that tripling the amount of anhydride in the prior art epoxy resin (Sample No. 2 versus Sample No. 1) had little effect on the water contact angle. Likewise, doubling the amount of anhydride in the epoxy modified butadiene adhesive had little effect on the contact angle beyond the effect achieved with 5.5 weight percent of the anhydride in the adhesive.

During a curing operation using a relatively low stress, substantially flexible adhesive, polar compounds may outgas through the fluid supply slots 46 and 48 and into the fluid channels 32, fluid chambers 34, and exit through the nozzle holes 36 (FIG. 3). As the polar compounds flow through the flow features of the ejection head 12, at least a portion of the polar compounds may deposit on the flow feature surfaces thereby increasing the surface energy of the flow feature surfaces so that wettability and thus fluid flow characteristics are improved.

It will be recognized by those skilled in the art, that the disclosed embodiments described above may be applicable to a wide variety of micro-fluid ejection heads, including but not limited to, ink jet printing heads. Such micro-fluid ejection devices may include liquid coolers for electronic components, micro-oilers, pharmaceutical delivery devices, and the like.

Having described various aspects and embodiments herein and several advantages thereof, it will be recognized by those of ordinary skill that the disclosed embodiments are susceptible to various modifications, substitutions and revisions within the spirit and scope of the appended claims.

What is claimed is:

1. A method for improving fluid flow in one or more flow features of a micro-fluid ejection head, the method comprising:

bonding a substrate having a flow feature layer to an ejection head body using a relatively low stress, substantially flexible adhesive containing a relatively volatile polar organic compound; and curing the adhesive under conditions sufficient to induce outgassing of at least a portion of the relatively volatile polar organic compound on at least a portion of a flow feature surface sufficient to increase fluid wetting of the flow feature surface.

2. The method of claim 1, wherein the relatively volatile polar organic compound is effective to decrease the contact angle of the flow feature surface.

3. The method of claim 1, wherein the adhesive comprises an adhesive selected from the group consisting of a silicone adhesive, an epoxy modified butadiene adhesive, and a siloxane modified epoxy resin.

4. The method of claim 1, wherein the relatively volatile polar organic compound comprises a compound selected from the group consisting of a silane, a carboxylic acid ester, and an anhydride.

5. The method of claim 4, wherein the anhydride comprises an anhydride selected from the group consisting of ethanoic anhydride, cyclopropanecarboxylic propanoic anhydride, butanedioic anhydride, succinic anhydride, acetic anhydride, cyclohexanecarboxylic anhydride, hexanoic anhydride, phthalic anhydride, and methyl tetrahydrophthalic anhydride.

6. The method of claim 4, wherein the silane comprises γ-glycidoxypropyltrimethoxysilane.

7. The method of claim 4, wherein the ester comprises an ester selected from the group consisting of methyl ethanoate, ethyl ethanoate, methyl propanoate, and methyl butyrate.

8. The method of claim 1, wherein the adhesive contains from about 1 to about 50 percent by weight of the relatively volatile polar organic compound before curing.

9. The method of claim 1, wherein the flow features are provided by a process selected from the group consisting of laser ablation, photolithographic techniques, and a combination of laser ablation and photolithographic techniques.

10. The method of claim 1, wherein the surface energy of one or more of the flow features is substantially increased.

* * * * *